United States Patent [19]

Yalowega

[11] Patent Number: 4,779,661

[45] Date of Patent: Oct. 25, 1988

[54] VERTICAL BLIND CLIPS

[76] Inventor: Ed Yalowega, 535 - 21 Street, N., Lethbridge, Alberta, Canada, T1H 3R2

[21] Appl. No.: 10,244

[22] Filed: Feb. 2, 1987

[51] Int. Cl.[4] ..... E06B 9/38

[52] U.S. Cl. ..... 160/178.1; 160/166.1

[58] Field of Search ..... 160/178 R, 178 B, 166 A, 160/168 R, 176 R, 38, 39

[56] References Cited

U.S. PATENT DOCUMENTS 4,079,770 3/1978 Woodle ..... 160/39 X 4,301,767 11/1981 Willinger et al. ..... 248/231 A X

*Primary Examiner*—Ramon O. Ramirez

*Assistant Examiner*—Blair M. Johnson

*Attorney, Agent, or Firm*—William R. Hinds; George H. Dunsmuir

[57] ABSTRACT

A bracket for supporting an additional vane or vanes on the end of a vertical blind track to hide the blind controls or the side of the window opening containing the blind includes an extensible body defined by slidably interconnected front and rear clips for mounting the bracket on the blind track, and at least one inverted L-shaped arm connected to the body, and extending outwardly and downwardly over the end of the track for carrying the extra vane or vanes.

10 Claims, 1 Drawing Sheet

VERTICAL BLIND CLIPS

BACKGROUND OF THE INVENTION

This invention relates to a bracket for a vertical blind, and in particular to a bracket for supporting a vane on a vertical blind.

So-called vertical blinds have recently achieved a high degree of consumer acceptance. The blinds are defined by top tracks, with a plurality of vanes suspended therefrom for rotation around a vertical axis and horizontal movement between open and closed positions. One problem with such blinds is that the blind controls, which are normally located at one end of the blind track are always at least partially visible. Moreover, with a blind in the closed position, the sides of the window frame are also visible.

The object of the present invention is to solve the above-identified problem by providing a relatively simple bracket for supporting at least one additional vane on either end of a vertical blind track.

SUMMARY OF THE INVENTION

Accordingly, the present invention relates to a bracket for adjustably supporting a vane on a vertical blind track at an end of the track such that the adjustably supported vane is adjustable to cover the blind controls or the side of a window opening in which the vertical blind track may be mounted, comprising a main body for mounting on the top of a vertical blind track, said main body comprising first and second components, each component having a generally horizontally extending part and a generally downwardly extending part located adjacent one end of the horizontally extending part, the horizontally extending part of the first component including track means slidably receiving the horizontally extending part of the second component such that the downwardly extending parts of the two components are located adjacent the ends of the main body and are adjustable toward and away from each other by varying the degree of slidable engagement of the horizontal part of the second component in the track means of the first component such that the main body can be mounted on the top of a vertical blind track and adjusted so as to embrace the front and rear surface of the track between said downwardly extending parts, means forming slot means on the horizontally extending part of one of said components for adjustably receiving an arm for supporting a vane adjacent the end of the track, said arm including a generally horizontal arm part adjustably mounted in said slot means and extending generally outwardly from said main body and a vertical blind track on which it may be mounted such that the arm can be rotatably adjusted to lie generally parallel to the blind track or forwardly at an angle to the blind track, and hook means on the outer part of said arm for supporting a vane such that rotatable adjustment of the arm positions the vane selectively to cover controls of the vertical blind or the side of a window opening adjacent the end of the blind track.

The invention also provides a bracket in accordance with the preceding paragraph in combination with a vertical blind track, said main body being mounted atop one end of the blind track with said downwardly extending parts adjusted to firmly embrace front and rear surfaces of the track, said slot means extending between said front and rear surfaces, and said arm part extending generally transversely of said slot means for rotatable adjustment horizontally between positions generally parallel to said blind track and forwardly at an angle to the blind track.

BRIEF DESCRIPTION OF THE DRAWINGS

The invention will now be described in greater detail with reference to the accompanying drawing, which illustrates a preferred embodiment of the invention, and wherein.

DESCRIPTION OF THE PREFERRED EMBODIMENTS

Figures 1, 2, 3, 4, 5:
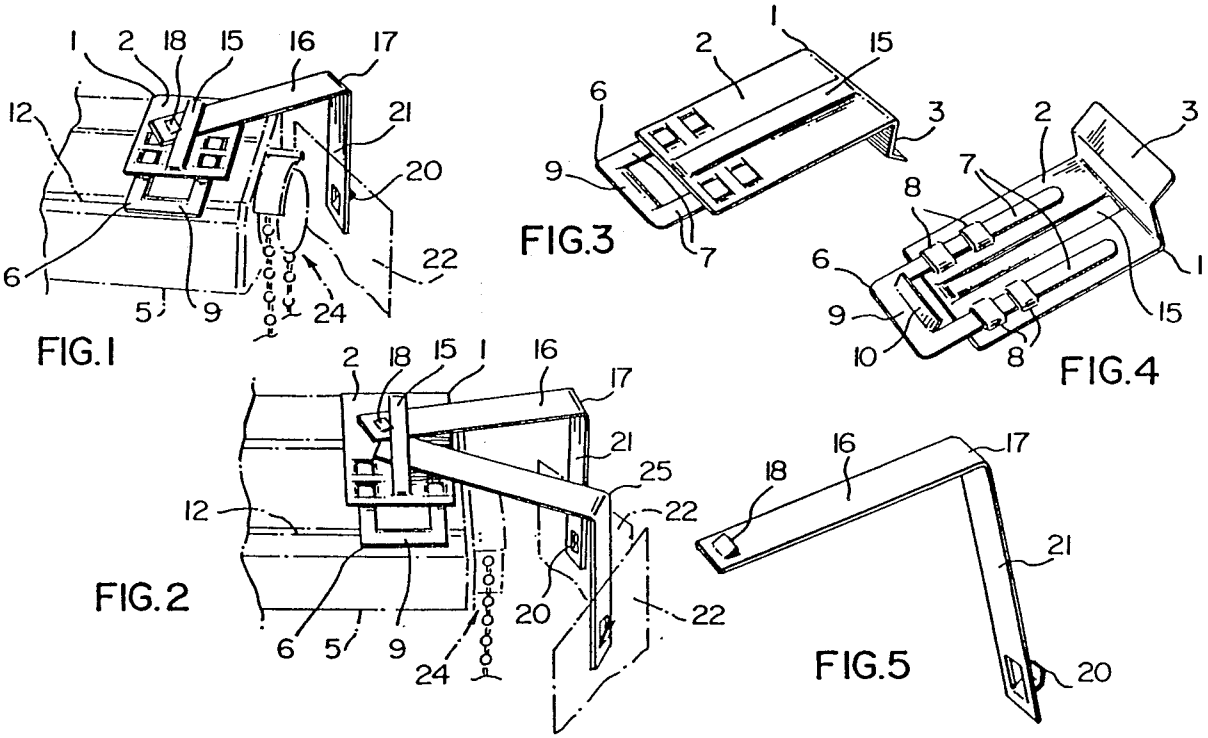
FIG. 1 is a schematic perspective view from above and one end of a bracket in accordance with the present invention mounted on an end of a vertical blind track.
FIG. 2 is a top perspective view of a modified version of the bracket of FIG. 1.
FIG. 3 is a top perspective view of the body of the bracket of FIGS. 1 and 2.
FIG. 4 is a bottom perspective view of the body of FIG. 3.
FIG. 5 is a perspective view of an arm used in the bracket of FIGS. 1 and 2.

With reference to the drawing, the bracket of the present invention is defined by an elongated generally L-shaped body 1, including a normally horizontal top portion 2, and a generally V-shaped vertical arm 3. The arm 3 defines a clip for engaging the grooved rear surface (not shown) of a vertical blind track 5. A second, U-shaped clip 6 is slidably mounted in the horizontal portion 2 of the body 1. The clip 6 is defined by a pair of arms 7 slidably mounted in tracks 8 in the body 1. The tracks 8 are defined by displaced portions of the horizontal portion 2 of the body 1. The friction fit between the arms 7 and the tracks 8 is sufficiently tight that the clip 6 will remain in one position until manual force is applied to the closed end 9 of the clip. Such closed end 9 is defined by a web of material extending between outer ends of the arms 7. A downwardly and inwardly extending lug or hook 10 is provided on the end 9 for engaging a groove 12 in the front face of the track 5. Thus, the bracket can be releasably mounted on the track 5 near one end thereof.

A central, longitudinally extending displaced strip 15 is provided on the top surface of the body portion 2 for defining slots, which receive the horizontal portion 16 of a L-shaped arm 17. The arm 17 is retained in the slots beneath the strip 15 by a hook 18 on one end of such arm 17. A second hook 20 is provided on the vertical portion 21 of the arm 17 for holding a blind vane 22. It will be appreciated that the arm 17 can be rotated to position the vane 22 at an angle to the end of the track 5, or parallel to such end. Thus, the additional vane 22 held by the arm 17 can be used to hide the blind controls 24 or the side (not shown) of the window frame regardless of whether the blind is in the open or closed position.

With reference to FIG. 2, one or more additional arms 25 can be attached to the body 1 to carry additional vanes 22. The additional arms 25 can be the same as the arm 17, or alternatively the hook 18 in the horizontal portion of the arm can be omitted, the arm 25 being slid under the arm 17.

The operation or use of the bracket is obvious from the foregoing. The bracket is preferably produced from thin sheet metal, but other suitable material may be used.

Thus, there has been described a simple bracket for use on the end of a vertical blind track; the bracket holding an additional vane or vanes for hiding the blind controls or for covering the sides of the window frame at the ends of the track.

What is claimed is:

1. A bracket for adjustably supporting a vane on a vertical blind track at an end of the track such that the adjustably supported vane is adjustable to cover the blind controls or the side of a window opening in which the vertical blind track may be mounted, comprising a main body for mounting on the top of a vertical blind track, said main body comprising first and second components, each component having a generally horizontally extending part and a generally downwardly extending part located adjacent one end of the horizontally extending part, the horizontally extending part of the first component including track means slidably receiving the horizontally extending part of the second component such that the downwardly extending parts of the two components are located adjacent the ends of the main body and are adjustable toward and away from each other by varying the degree of slidable engagement of the horizontal part of the second component in the track means of the first component such that the main body can be mounted on the top of a vertical blind track and adjusted so as to embrace the front and rear surface of the track between said downwardly extending parts, means forming slot means on the horizontally extending part of one of said components for adjustably receiving an arm for suporting a vane adjacent the end of the track, said arm including a generally horizontal arm part adjustably mounted in said slot means and extending generally outwardly from said main body and a vertical blind track on which it may be mounted such that the arm can be rotatably adjusted to lie generally parallel to the blind track or forwardly at an angle to the blind track, and hook means on the outer part of said arm for supporting a vane such that rotatable adjustment of the arm positions the vane selectively to cover controls of the vertical blind or the side of a window opening adjacent the end of the blind track.

2. A bracket as claimed in claim 1 wherein said slot means is defined by a displaced strip partially severed and displaced out of the surface of one of said components such that said arm part passes over the surface and under and beyond the displaced strip.

3. A bracket as claimed in claim 2 wherein said displaced strip is elongate in the direction between the ends of said one component and is connected with said one component only at the ends of the displaced strip.

4. A bracket as claimed in claim 3 wherein said displaced strip is displaced upwardly out of the surface of said first component, and said track means comprise downwardly displaced and partially severed areas of said first component.

5. A bracket as claimed in claim 3 wherein said arm is of generally inverted L-shaped comprising said horizontal arm part and a vertical arm part depending from the outer end of the horizontal arm part, said hook means being carried by said vertical arm part.

6. A bracket as claimed in claim 2 wherein said displaced strip and the slot means defined thereby are substantially longer than the width of said arm part to facilitate rotational adjustment of said arm part.

7. A bracket as claimed in claim 6 wherein said arm part which passes under and beyond said displaced strip is formed with a displaced projection to prevent unintentional removal of the arm part from the slot means.

8. A bracket as claimed in claim 2 wherein said main body and said arm are sheet metal stampings.

9. A bracket as claimed in claim 1 wherein the slidable engagement between said track means and said horizontally extending part of the second component is a friction fit.

10. A bracket as claimed in claim 1 in combination with a vertical blind track, said main body being mounted atop one end of the blind track with said downwardly extending parts adjusted to firmly embrace front and rear surfaces of the track, said slot means extending between said front and rear surfaces, and said arm part extending generally transversely of said slot means for rotatable adjustment horizontally between positions generally parallel to said blind track and forwardly at an angle to the blind track.

* * * * *